United States Patent [19]

Wilzig et al.

[11] 4,003,593

[45] Jan. 18, 1977

[54] PUSH DOOR-LATCH OPENER

[76] Inventors: Herbert Wilzig, 1809 S. Stearns, Los Angeles, Calif. 90035; Charles J. Schuessler, 1340 E. Ruddock, Covina, Calif. 91722

[22] Filed: Feb. 23, 1976

[21] Appl. No.: 660,245

[52] U.S. Cl. ..... 292/92; 70/92; 292/165; 292/DIG. 66

[51] Int. Cl.[2] ..... E05F 15/20

[58] Field of Search ..... 292/92, 165 X, 167, 292/173, 34, 36, DIG. 65, DIG. 66 X; 70/92 X, DIG. 10

[56] References Cited

UNITED STATES PATENTS

| | | | |
|---|---|---|---|
| 2,201,444 | 5/1940 | Marsh | 292/165 |
| 3,477,754 | 11/1969 | Check | 292/165 |
| 3,811,717 | 5/1974 | Floyd et al. | 292/92 |

*Primary Examiner*—J. Franklin Foss
*Attorney, Agent, or Firm*—Poms, Smith, Lande & Glenny

[57] ABSTRACT

A push door-latch opener suitable for hospital rooms including a door mounting plate, a horizontal pivoting rod attached to the plate, a vertical pivoting rod attached to said plate and located above the horizontal rod, a horizontal bell crank pivoted about said vertical rod and having a first arm projecting into the plane of the door and a second arm being substantially parallel to the plane of the door, a torsion spring for biasing said bell crank in a direction so that the second arm is biased in the direction of the first arm, and a downwardly-directed push handle pivoted about said horizontal rod and being biased to a first out position and being adapted to be pushed to a second in position, the push handle having above the horizontal rod an upwardly-directed projection which engages the inner surface of the second arm of the bell crank so that when the push handle is pushed, the projection turns the second arm away from the door and simultaneously turns the first arm, thereby operating a latching mechanism.

A preferred embodiment of the push door-latch opener is provided with a fire-safety lock mechanism. The push handle of this embodiment includes a downwardly-directed, laterally-extending projection below the horizontal rod, and the door-latch opener further includes a blocking rod contained within a housing attached to the mounting plate below the horizontal rod, a coil spring for biasing the rod upwardly, and a fusable pin extending through the housing and into the blocking rod which will fuse at the high temperature of a fire and thereby release the blocking rod upwardly to block the inward movement of the push handle.

2 Claims, 5 Drawing Figures

PUSH DOOR-LATCH OPENER

BACKGROUND OF THE INVENTION

1. Field of the Invention

This invention relates to door openers, particularly door-latch openers, and more particularly push door-latch openers with a fire-safety lock suitable for use in hospitals.

2. Description of the Prior Art

The use of push/pull door-latch openers in hospitals and other places is now quite common. Their use is advantageous because they allow doors which are conventionally latched closed to be opened with only one motion. Specifically, the side of the door having the pull handle is opened by merely pulling on the handle, which both slides the latch bolt to the open position and pulls the door open. Similarly, the side of the door having the push handle is opened by merely pushing the handle, which both slides the latch bolt to the open position and pushes the door open. This ease of operation is particularly useful in hospitals where employees frequently have their hands occupied thereby preventing an employee from firmly grasping a door knob and turning it. The push/pull door latches also allow a person to open a door without the use of his hands, by merely pushing the push handle with his body or pulling the pull handle with an arm.

Presently, the push door-latch openers used employ an upwardly-directed handle. However, the push door-latch openers presently employed have proven to be undesirable for two important reasons. First, the upwardly-directed handle poses a definite safety hazard in that it provides a dangerous projection upon which people may fall and injure themselves, and it provides a projection with which people and paraphernalia may become entangled. Secondly, the present push door-latch openers are not provided with a fire-safety lock and their present construction makes it difficult to so provide.

Recently, it has become a requirement imposed by both hospitals and governmental agencies that hospital room doors be provided with a means for locking them during fires. It is the purpose of this fire-safety requirement to keep doors closed during fires in order to reduce the amount of oxygen fed to the fire and thereby aid in controlling the spread of the fire. It is also necessary to lock the door in a manner so as to prevent the door from being accidentally opened during a fire, such as by being opened by the force of falling objects or by the force of the high-pressure water used to fight the fire. The doors to hospital rooms are built to open inwardly, thereby requiring a push handle on the outside and a pull handle on the inside. This is done so that doors will not unexpectedly swing open into hallways. To avoid trapping patients within the rooms, only the push handle on the outside of the room is provided with a fire-safety lock, and thereby still allowing a patient to open the door from the inside.

It is the primary object of this invention to provide a novel push door-latch opener.

It is another object of this invention to provide a push door-latch opener with a downwardly-directed handle.

Yet another object of this invention is to provide a push door-latch opener having a heat-actuated fire-safety lock.

Further objects and advantages of this invention will become apparent to those skilled in the art from the following description.

SUMMARY OF THE INVENTION

The push door-latch opener of this invention broadly includes a mounting means for attaching the push door-latch opener to a door; horizontal pivoting means attached to said mounting means; vertical pivoting means attached to said mounting means and being positioned above the horizontal pivoting means; a horizontal bell crank pivoted about said vertical pivoting means, having a first arm projecting into the plane of the door and a second arm substantially parallel to the plane of the door; biasing means for biasing said bell crank in a direction so that the second arm is biased in the direction of the first arm; and a downwardly-directed push handle pivoted about said horizontal pivoting means, the push handle being biased to a first out position and being adapted to be pushed to a second in position, the push handle having above the horizontal pivoting means an upwardly-directed projection which engages the inner surface of the second bell crank arm so that pushing the push handle will cause the upward projection to turn the second arm away from the plane of the door and simultaneously turn the first arm, thereby operating the door's latching mechanism.

In a preferred embodiment, the push handle is provided, at a location below the horizontal pivoting means, with a downwardly-directed laterally-extending projection which is spaced from the mounting means; and the mounting means includes a blocking member; a housing located below said downwardly-directed projection in which the blocking member is contained and means for biasing the blocking member upwardly; and restraining means for restraining the upward movement of the blocking member adapted to yield at a high temperature, thereby releasing the blocking member upwardly so as to engage the inner surface of said downwardly-directed projection and thereby prevent the inward movement of the latch handle.

DETAILED DESCRIPTION OF THE INVENTION

Figure 1:
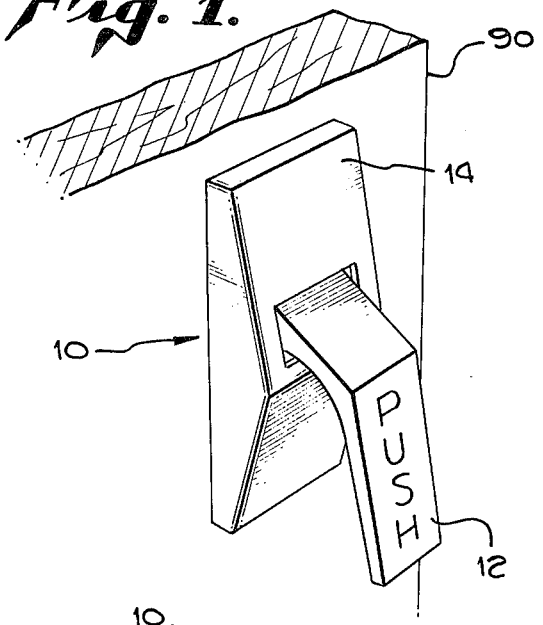
FIG. 1 is a perspective view of the push door-latch opener of the present invention shown attached to a door.
Figure 4:
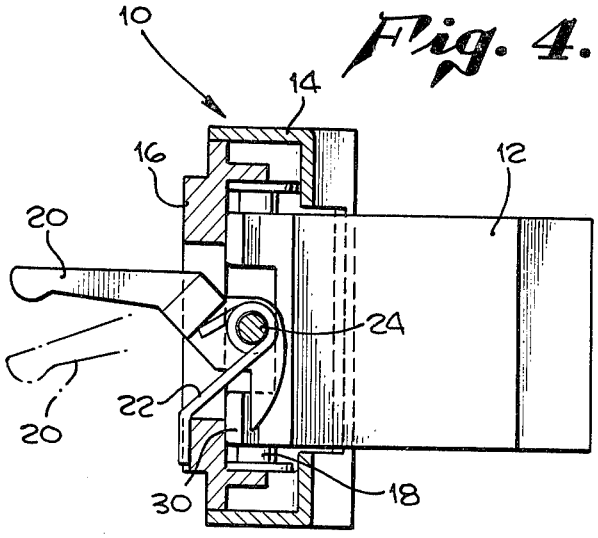
FIG. 4 is a top, cross-sectional view of the push door-latch opener taken along the line IV—IV of FIG. 3.
Figure 2:
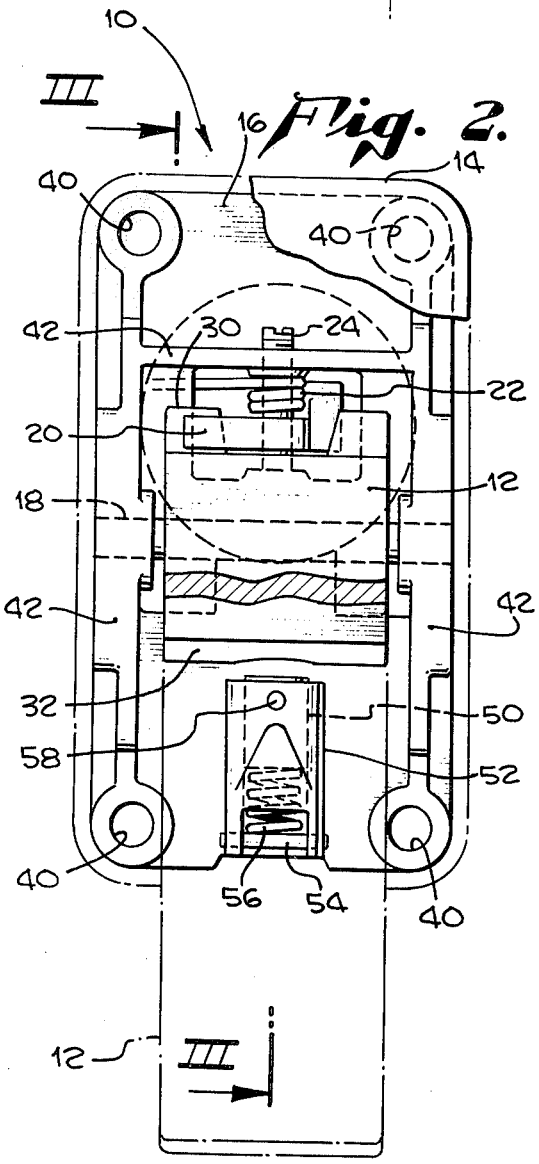
FIG. 2 is a front-elevational view of the push door-latch opener with the cover plate removed.
Figure 3:
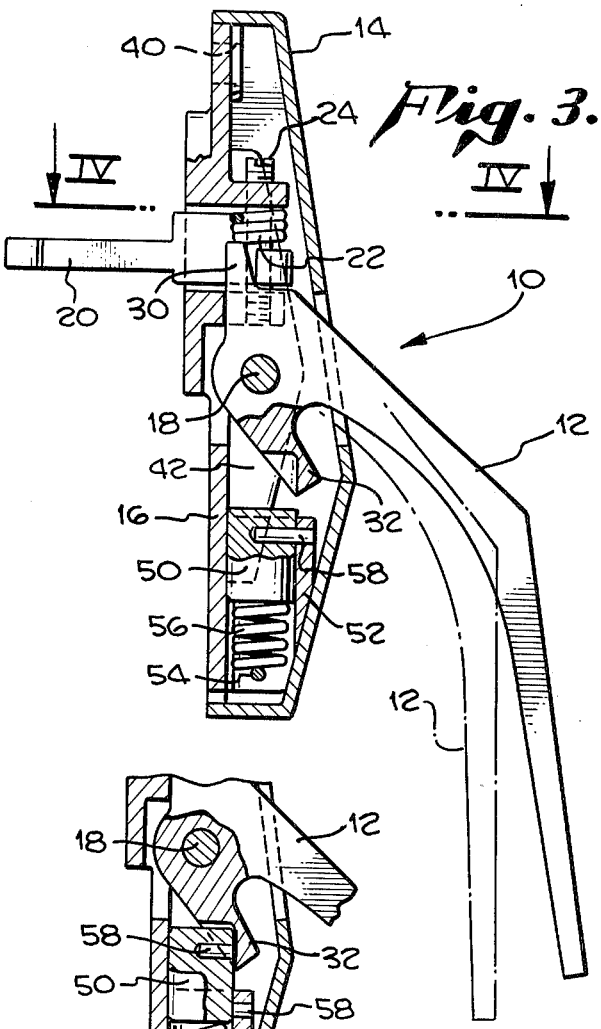
FIG. 3 is a side, cross-sectional view of the push door-latch opener of FIG. 2 taken along the line III—III of FIG. 2.

Referring now more particularly to the drawing, FIG. 1 illustrates the push door-latch opener 10 attached to a door 90, and which includes push handle 12 and cover plate 14. FIGS. 2, 3, and 4 illustrate the mounting plate 16, push handle rod 18 around which the push handle pivots, bell crank 20, bell crank spring 22, and bell crank rod 24.

Particularly, the mounting means for attaching the push door-latch opener to a door is exemplified by mounting plate 16 which includes mounting holes 40 through which fasteners are passed and secured to the door, and which are surrounded by circular bosses which provide support to the mounting plate. The mounting plate is also provided with raised ridges 42, which provide additional support to the mounting plate.

The horizontal pivoting means is provided by push handle rod 18 which extends through push handle 12 and is securely attached at both ends to the mounting plate via the raised ridges 42. The push handle of the invention is exemplified by push handle 12 which is provided with a bore through which push handle rod 18 passes and which is adapted to freely pivot about said rod. The push handle also includes an upwardly-directed projection disposed above said horizontal pivoting means which is adapted to operate the bell crank, as will be described below. The upwardly-directed projection is exemplified by projection 30. The push handle also includes a downwardly-extending member which is adapted to be pushed in toward the door. The push handle also includes a downwardly-directed, and laterally-extending projection which is adapted to be engaged and blocked by a fire-safety rod, to be described below. This downwardly-directed projection is exemplified by projection 32.

The bell crank and vertical pivoting means of the push door-latch opener are exemplified by bell crank 20 and bell crank rod 24. As more clearly shown in FIG. 4, bell crank 20 is provided with two horizontal arms, one relatively long arm which is adapted to extend into the door and mechanically operate any conventional latch mechanism, and a second shorter arm whose normal position is substantially parallel to the door and which is adapted to be engaged by the upwardly-directed projection 30 of push handle 12 to thereby turn bell crank 20 in a counterclockwise direction as viewed in FIG. 4. Bell crank 20 is also provided with a bore through with bell crank rod 24 passes and which rod is attached to the mounting plate. Also provided is bell crank spring 22, which in the drawing is a torsion spring having one end secured to the mounting plate and the other end firmly attached to the bell crank, and which biases the bell crank in a clockwise direction as viewed in FIG. 4.

It is to be understood that whereas the illustrated door-latch opener is constructed for use on the right side of a door, the push door-latch opener of this invention is easily adapted for placement on the left side of a door. This is accomplished by placing the second bell crank arm, the arm parallel to the door, on the side opposite to that illustrated, biasing the bell crank so that the second is biased toward the first arm, and repositioning the upwardly-directed projection 30 so that it again engages the inner surface of the second arm. It is noted that in both cases, the bell crank is biased so that the second arm is biased in the direction of the first arm.

In addition to biasing the bell crank, the bell crank spring, through the engagement of the bell crank with the upwardly-directed projection 30 of the push handle, biases the push handle in an outward direction. Therefore, by pushing the push handle inwardly, projection 30 engages and pushes the arm of bell crank 20 away from the door and turns the bell crank, thereby operating the door-latch mechanism (not shown). The relative positions of push handle 12 and bell crank 20, in their normal and operating positions, are shown in FIG. 3 and FIG. 4 respectively with the phantom lines indicating the operating position.

A feature of a preferred embodiment of the push door-latch opener of this invention is a fire-safety lock mechanism. The fire-safety lock operates by moving a blocking member into a position to block the inward movement of the push handle upon sensing a high temperature indicating the presence of fire, and thereby preventing the operation of the push door-latch opener.

Figure 5:
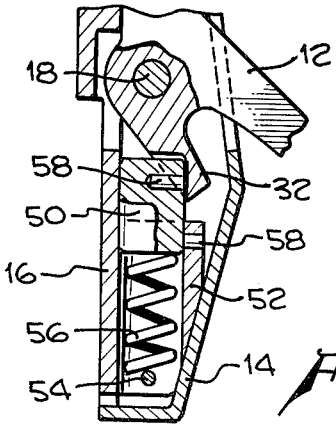
FIG. 5 is a side, cross-sectional view illustrating the fire-safety lock mechanism.

Specifically as shown in FIG. 3 and FIG. 5, the locking mechanism comprises a blocking member, exemplified by rod 50, which is contained in housing 52 integral with mounting plate 16. The bottom of the housing is constructed to prevent rod 50 from passing through, as accomplished by pin 54 which extends through and across the bottom of housing 52. Coil spring 56 provides the biasing means for biasing rod 50 in an upwardly direction.

The blocking member, rod 50, is restrained within the housing by a fusable material which is selected to yield at a selected high temperature and thereby release the blocking member upwardly and into a position to block the inward movement of the push handle. As exemplified in the drawing, the restraining means is provided by fusable pin 58 which extends through a hole in housing 52 and into a hole in rod 50, and thereby restrains the upward movement of rod 50. In the presence of a fire, the high temperature will fuse pin 58 and allow it to be sheared by the force of coil spring 56, resulting in rod 50 moving upwardly and between the mounting plate and the downwardly-directed projection 32 of the push handle. Rod 50 engages the inside surface of projection 32 and thereby prevents the operation of the push door-latch opener.

The foregoing detailed description of the apparatus of this invention is exemplary only, and it should be understood that other modifications obvious to those skilled in the art may be made, and are within the scope of this invention, which is defined and limited only by the following claims.

We claim:

1. A push door-latch opener having mounting means for attaching said door-latch opener to a door, comprising:

horizontal pivoting means attached to said mounting means;

vertical pivoting means attached to said mounting means, said vertical pivoting means being positioned above said horizontal pivoting means;

a horizontal bell crank pivoted about said vertical pivoting means, having a first arm projecting into the plane of the door and a second arm being substantially parallel to the plane of the door;

biasing means for biasing said bell crank in a direction so that the second arm is biased in the direction of the first arm;

a downwardly-directed push handle pivoted about said horizontal pivoting means, said push handle being biased to a first out position and being adapted to be pushed to a second in position; said push handle having above the horizontal pivoting means an upwardly-directed projection which engages the inner surface of the second arm of said bell crank so that when the push handle is pushed, the projection turns the second arm away from the door and simultaneously turns the first arm, thereby operating a latching mechanism, and said push handle further includes, below said horizontal pivoting means, a downwardly-directed, laterally-extending projection which is spaced from the mounting means when the push handle is in the out position;

a push handle blocking member;

a housing attached to said mounting means below said downwardly-directed projection, said housing containing said blocking member;

biasing means for biasing said blocking member upwardly; and restraining means for restraining the upward movement of said blocking member and adapted to yield at a high temperature, thereby releasing said blocking member upwardly so as to engage the inner surface of said downwardly-directed projection and thereby prevent the inward movement of the push handle.

2. A push door-latch opener having a mounting plate for attaching said door-latch opener to a door, comprising:

a horizontal pivoting rod attached to said mounting plate;

a vertical pivoting rod attached to said mounting plate, said vertical rod being positioned above said horizontal rod;

a horizontal bell crank pivoted about said vertical rod, having a first arm projecting into the plane of the door and a second arm being substantially parallel to the plane of the door;

a torsion spring for biasing said bell crank in a direction so that the second arm is biased in the direction of the first arm, one end of said spring being attached to said mounting plate and the other end being attached to said bell crank; and a downwardly-directed push handle pivoted about said horizontal rod, said push handle being biased to a first out position and being adapted to be pushed to a second in position; said push handle having about the horizontal pivoting rod an upwardly-directed projection which engages the inner surface of the second arm of said bell crank so that when the push handle is pushed, the projection turns the second arm away from the door and simultaneously turns the first arm, thereby operating a latching mechanism, and said push handle further includes, below said horizontal rod, a downwardly-directed, laterally-extending projection which is spaced from the mounting plate when the push handle is in the out position;

a push handle blocking rod;

a housing attached to said mounting means below said downwardly-directed projection, said housing containing said blocking rod;

a coil spring within said housing and below said rod for biasing said rod upwardly; and a fusable pin extending through said housing and into said rod for restraining the upward movement of said rod, said fusable pin adapted to yield at a high temperature, thereby releasing said blocking rod upwardly so as to engage the inner surface of said downwardly-directed projection and thereby prevent the inward movement of the push handle.

* * * * *